US005706795A

United States Patent [19]

Gerwig

[11] Patent Number: 5,706,795

[45] Date of Patent: Jan. 13, 1998

[54] MULTI-PURPOSE PROJECTILE LAUNCHER

[76] Inventor: Phillip L. Gerwig, 3685 Pleasant Valley Rd., Perrysville, Ohio 44864

[21] Appl. No.: 684,943

[22] Filed: Jul. 19, 1996

[51] Int. Cl.[6] ..... F41B 11/06

[52] U.S. Cl. ..... 124/71; 124/83; 124/85

[58] Field of Search ..... 124/57, 71, 73, 124/74, 76, 83, 85

[56] References Cited

U.S. PATENT DOCUMENTS

| | | | |
|---|---|---|---|
| 2,964,031 | 12/1960 | Dotson | 124/57 |
| 3,056,395 | 10/1962 | Merz et al. | 124/74 X |
| 3,142,293 | 7/1964 | Harter | 124/57 |
| 3,830,214 | 8/1974 | Curtis . | |
| 4,539,969 | 9/1985 | Saxby | 124/57 |
| 4,601,278 | 7/1986 | Kim | 124/57 |
| 4,697,523 | 10/1987 | Saxby | 102/440 |
| 4,826,050 | 5/1989 | Murphy et al. | 222/175 |
| 5,078,117 | 1/1992 | Cover | 124/71 |
| 5,353,779 | 10/1994 | Lyon | 124/57 |
| 5,373,832 | 12/1994 | D'Andrade | 124/73 X |
| 5,373,833 | 12/1994 | D'Andrade | 124/73 X |

*Primary Examiner*—John A. Ricci

*Attorney, Agent, or Firm*—Pearne, Gordon, McCoy & Granger LLP

[57] ABSTRACT

A multi-purpose projectile launcher including a body, a barrel forwardly projecting from the body, and a tube forwardly projecting from the body within the barrel and concentric with the barrel to form an annular-shaped space therebetween. A tubular projectile extends over the tube within the barrel and forms a seal between the barrel and the tube. A firing assembly releases gas from a cartridge into an interior chamber, which is in fluid flow communication with the space behind the projectile, to drive the projectile over the tube and out of the barrel. The gas cartridge can be a pressurized gas cartridge having $CO_2$ or $N_2$ or a self-generating gas cartridge having gunpowder. The projectile can be longitudinally segmented so that a deflector located at a forward end of the tube separates and deflects the segments radially outward from the tube at equal velocities. The segments can be utilized to evenly deploy hobble lines or a net.

20 Claims, 5 Drawing Sheets

MULTI-PURPOSE PROJECTILE LAUNCHER

BACKGROUND OF THE INVENTION

FIELD OF THE INVENTION

The present invention generally relates to projectile launching systems and, more particularly, to non-lethal systems for suppression, incapacitation, and/or apprehension of individuals.

DESCRIPTION OF RELATED ART

One type of known projectile launching system deploys projectiles having a relatively large mass and a relatively large impact surface to reduce unit area energy while maintaining a high inertia energy. The projectile is typically launched from a barrel at high velocity by the release of stored gas-pressure energy. The high velocity projectile strikes and incapacitates the target individual.

Another known type of projectile launching system deploys a net having weights attached to various points about the periphery of the net. The launching system has multiple barrels angling outward. A weight is launched from each of the barrels by the release of stored gas-pressure energy. The weights project outwardly relative to one another to deploy the net. The deployed net strikes and apprehends the target individual. The net, however, is often deployed unevenly because the weights are traveling at different speeds. Additionally, this system is bulky and expensive.

Each of these types of projectile launching systems are limited to deploying a single type of projectile. Accordingly, there is a need in the art for an improved launching system which deploys a variety of different types of projectiles from a common launcher. Additionally, there is a need in the art for a launching system which launches multiple projectiles at the same speed.

SUMMARY OF THE INVENTION

The present invention provides a launcher for deploying a projectile which overcomes at least some of the above-noted problems of the related art. The projectile launcher includes a body, a barrel forwardly projecting from the body, and a tube forwardly projecting from the body within the barrel and substantially concentric with the barrel. The barrel and the tube form an annular-shaped space therebetween for the projectile. The projectile is generally tubular-shaped and encircles the tube within the barrel. The projectile can be either solid or longitudinally segmented. With a segmented projectile, a deflector located at a forward end of the tube separates and deflects the segments radially outward from the tube. The projectile segments can be utilized to deploy a net or hobble line. The net or hobble line is evenly deployed because the projectile segments are launched from a single barrel at the same velocity.

BRIEF DESCRIPTION OF THE DRAWINGS

These and further features of the present invention will be apparent with reference to the following description and drawings, wherein.

DETAILED DESCRIPTION OF THE PREFERRED EMBODIMENT

Figure 2:
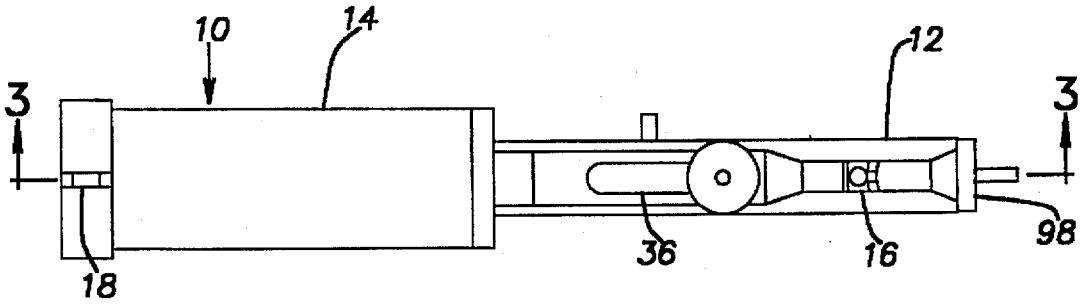
FIG. 2 is a plan view of the projectile launcher of FIG. 1.
Figure 1:
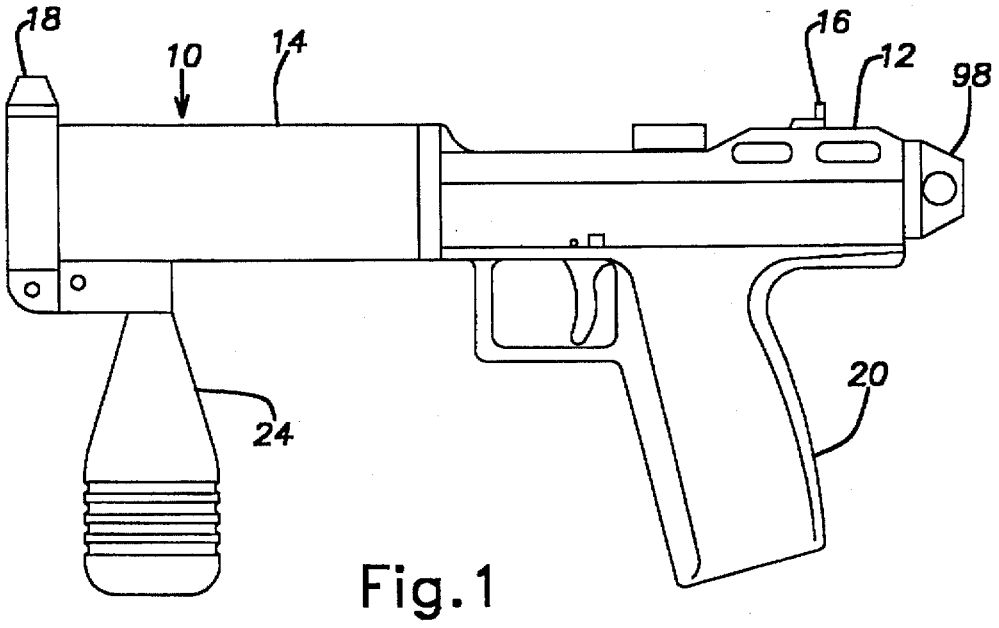
FIG. 1 is a elevational view of a projectile launcher according to the present invention.
Figure 3:
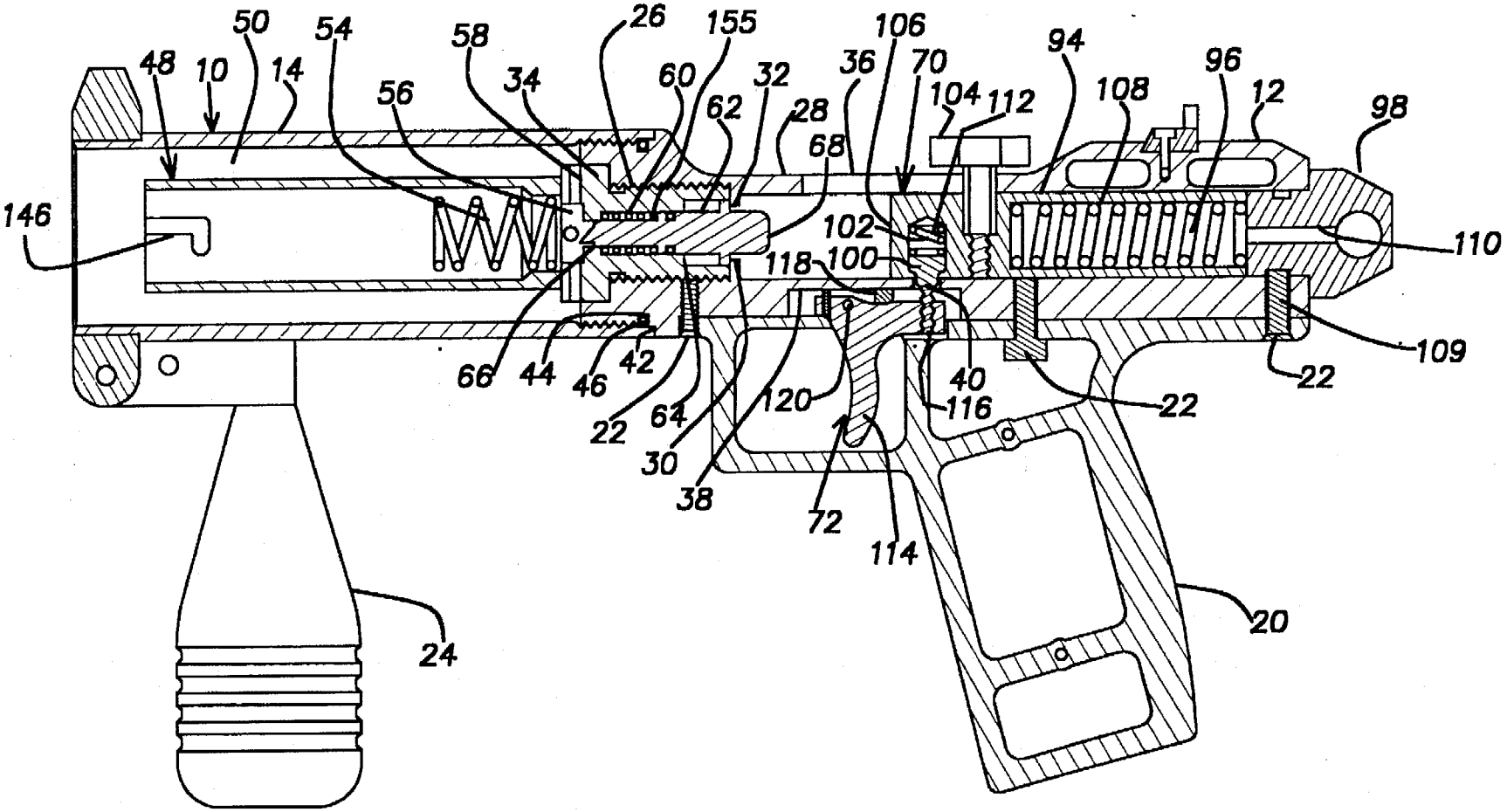
FIG. 3 is an enlarged elevational view, in cross-section, taken along line 3—3 of FIG. 2.

FIGS. 1–3 illustrate a multi-purpose projectile launcher 10 according to the present invention which fires a variety of different types of projectiles. The projectile launcher 10 includes a main body or receiver 12 and a barrel 14 attached to a forward end of the receiver 12. A rear sight 16 is attached to the top of the receiver 12 at the rear end of the receiver 12. A front sight band 18 is clamped around the forward end of the barrel 14. A rear grip 20 is mounted to the bottom of the receiver 12 by threaded fasteners 22. A front grip 24 is attached to the bottom of the front sight band 18 at the forward end of the barrel 14.

As best shown in FIG. 3, the receiver 12 has coaxial front and rear bores 26, 28 which are separated by an annular-shaped abutment wall 30. The abutment wall 30 forms a circular opening 32 which connects the front and rear bores 26, 28. The front bore 26 extends from the forward end of the receiver 12 and is open at the forward end of the receiver 12. The front bore 26 is internally threaded and provided with a counter bore 34. The rear bore 28 extends from the rearward end of the receiver 12 and is open at the rearward end of the receiver 12. A longitudinally extending elongate slot 36 is located at the top of the receiver 12 and opens into a front portion of the rear bore 28. A bottom cavity or recess 38 is located in the outer surface of the receiver 12 at the bottom of the receiver 12. The bottom recess 38 is generally located below the slot 36. A circular opening 40 vertically extends from the rearward end of the bottom recess 38 to rear bore 28.

The barrel 14 is tubular-shaped and attached to the forward end of the receiver 12. The rearward end of the barrel 14 has internal threads sized to mate with external threads on the forward end of the receiver. The barrel 14 engages a forward facing abutment 42 provided around the periphery of the receiver 12. A groove 44 is provided between the external threads and the abutment 42 for an o-ring 46 or other suitable sealing member. The o-ring 46 establishes a seal between the barrel 14 and the receiver 12.

A gas tube 48 is attached to the forward end of the receiver 12 and closes the front bore 26 of the receiver 12. The gas tube 48 has a tubular-shaped front portion coaxially extending within the barrel, a central portion with an outer diameter sized to mate with the counter bore 34 of the receiver front bore 26, and an externally-threaded rear portion having a diameter sized to mate with the internal threads of the receiver front bore 26. The outer diameter of the front portion is smaller than inner diameter of the barrel 14 to form an annular-shaped space 50 therebetween. The front portion has an inner diameter and a length sized for receiving a gas container or cartridge 52 (FIG. 7) of pressurized gas such as, for example, $CO_2$ or $N_2$ or of self-generating gas such as, for example, a gunpowder load. It is noted that the term gas cartridge as used within the present specification and claims is defined to include both pressurized gas cartridges and self-generating gas cartridges.

The rearward end of the front portion has an inner diameter reduced in sized to retain a helical-coil spring 54 therein. The spring 54 is compressed when the cartridge 52 (FIG. 7) is fully inserted into the front portion of the gas tube 48 and biases the gas cartridge 52 toward the open forward end of the gas tube 48 (best shown in FIG. 7).

The central portion of the gas tube 48 has a cylindrically-shaped cavity 56 which opens into the interior of the front portion of the gas tube 48. Openings or passages 58 radially extend from the cavity 56 to the outer periphery of the center portion to provide fluid flow communication between the cavity 56 and the annular-shaped space 50 between gas tube 48 and the barrel 50. The passages 58 open into the rearward end of the annular-shaped space 50 adjacent the forward end of the receiver 12. Preferably, there are multiple equally spaced apart passages 58.

The rear portion of the gas tube 48 has a longitudinally extending bore 60 and a concentric counter bore 62 to form a rearward facing shoulder or abutment 64. A connecting hole or opening 66 is provided to connect the central portion cavity 56 and the rear portion bore 60. The connecting opening 66 is concentric with both the central portion cavity 56 and the rear portion bore 60. The connecting opening 66 has a diameter smaller than the diameter of the rear portion bore 60.

Figure 20:
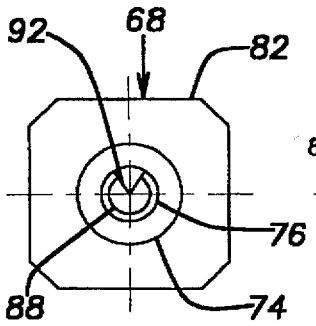
FIG. 20 is an enlarged, elevational, end view of the piercing pin of FIG. 19.
Figure 19:
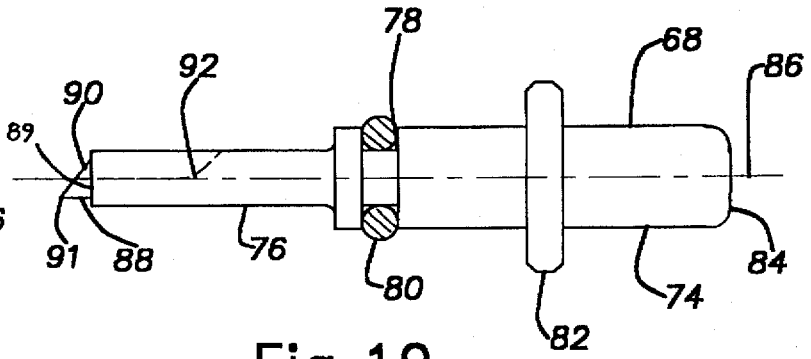
FIG. 19 is an enlarged, elevational, side view of a piercing pin of the projectile launcher of FIGS. 1–3.

The firing assembly includes a firing or piercing pin 68, a spring-loaded hammer mechanism 70, and a trigger mechanism 72. As best shown in FIGS. 3, 19, and 20, the piercing pin 68 has a cylindrically shaped rear-portion 74 with an outer diameter sized to closely slide within the bore 60 of the gas tube 48 and the opening 32 in the receiver abutment wall 30. The piercing pin also has and a cylindrically-shaped front portion 76 with a diameter sized to extend within the connecting opening 66 of the gas tube 48. The rear portion 74 has a groove 78 near the forward end of the rear portion 76 for an o-ring 80 or other suitable seal member. The o-ring 80 establishes a seal between the rear portion 74 of the piercing pin 68 and the bore 60 of the gas tube 48. A protrusion 82 radially extends around the periphery of the rear portion 74 which has an outer diameter sized to slide within the counter bore 62 of the gas tube 48. The protrusion 82 is preferably cut square to reduce the contact area between the protrusion 82 and the counter bore 62 and thereby friction created by relative movement therebetween. The protrusion 82 engages the rearward facing abutment 64 of the gas tube 48 to limit forward movement of the piercing pin 68 and engages the forward facing abutment wall 30 of the receiver 12 to limit rearward movement of the piercing pin 68. The rearward end of the rear portion 74 forms an impact surface 84 which is substantially perpendicular to the central axis 86 of the piercing pin 68.

The front portion 76 of the piercing pin 68 forms a piercing point 88. The piercing point 88 has an outer diameter which is smaller than the remainder of the front portion 76 to form a forward facing shoulder 89 which prevents the remainder of the front portion 76 from entering the cartridge 52 (FIG. 7) and sticking in the pierced opening in the cartridge 52. The piercing point 88 also has an angled surface 90 which forms a pointed cutting edge 91 at the forward end of the piercing pin 68. Preferably, the angled surface 90 is about 45 degrees relative to the central axis 86 of the piercing pin 68. A V-shaped groove 92 axially extends along a side of the front portion 76 opposite the pointed cutting edge 91 of the piercing point 88, that is, the "short side" of the angled surface 90. The groove 92 is open at the angled surface 90 and longitudinally extends for about one-half the length of the front portion 76 where the depth of the groove 92 has a smoothly transition to the outer periphery of the front portion 76.

As best shown in FIG. 3, the hammer mechanism 70 includes a hammer 94, a hammer spring 96, a spring plug 98, a sear 100, a sear spring 102, and a cocking knob 104. The hammer 94 is cylindrically-shaped with an outer diameter sized to be slideably received within the rear bore 28 of the receiver 12. The forward end of the hammer 94 forms a impact surface 106 which is substantially perpendicular to the central axis of the hammer 94. A longitudinally extending bore 108 is provided in the rear portion of the hammer 94 which is open at the rear of the hammer 94. The bore 108 has a diameter sized to receive the hammer spring 96 therein. The hammer spring 96 is helical-coil spring which forwardly biases the hammer 94 toward the forward end of the receiver 12. The spring plug 98 closes the rearward end of the receiver rear bore 28 to retain the hammer 94 and hammer spring 96 therein. A groove 109 extends about the periphery of the spring plug 98 which receives the end of one of the threaded fasteners 22 to lock the spring plug 98 in position. The spring plug 98 is provided with a longitudinally extending vent hole 110 which communicates a portion of the receiver rear bore 28 behind the hammer 94 with outside air.

A vertically extending bore 112 is provided in the forward portion of the hammer 94 and is open at the bottom of the hammer 94. The bore 112 has a diameter sized to slideably receive the sear 100. The sear 100 has a cylindrically shaped top portion sized to closely slide within the hammer bore 112 and a bottom portion sized to extend into the receiver opening 40. Preferably, the bottom portion of the sear 100 has a hemispherically-shaped end surface. The sear spring 102 is located within the hammer bore 112 above the sear 100. The sear spring 102 is a helical-coil spring which downwardly biases the sear 100 toward the receiver opening 40. The cocking knob 104 is threadably attached to the hammer 94 between the bores 108, 112. The cocking knob 104 vertically extends through the elongated slot 36 of the receiver 112.

The hammer 94 is cocked by rearwardly pulling the cocking knob 104 to rearwardly slide the hammer 94 within the rear bore 28 of the receiver 112. The rearward movement of the hammer 94 compresses the hammer spring 96 between the hammer 94 and the spring plug 98. The cocking knob 104 is pulled until the sear 100 is longitudinally aligned with the opening 40 of the receiver 12 and the sear spring 102 downwardly urges the bottom portion of the sear 100 into the receiver opening 40. The sear 100 prevents longitudinal movement of the hammer 94 in either direction and locks the hammer 94 in the cocked position as shown in FIG. 3. In the cocked position, potential energy is stored in the compressed hammer spring 96.

The trigger mechanism 72 includes a trigger 114, sear release pin 116, and a safety bar 118. The trigger 114 downwardly extends from the bottom recess 38 of the receiver 12 and is pivotally attached to the receiver 12 by a laterally extending pin 120. The pin 120 is located forward of the receiver opening 40 such that, when the trigger 114 is pulled in a rearward direction, the trigger 114 pivots about the pin 120 and the rearward end of the trigger 114 rises toward the sear 100. The rearward end of the trigger 114 is provided with the sear release pin 116 which vertically extends into the receiver opening 40 when the trigger 114 is pulled. The sear release pin 116 of the illustrated embodiment is a screw so that the release point of the sear is adjustable. The safety bar 118 laterally extends through the bottom recess 38 of the receiver 12 above the trigger 114. The safety bar 118 laterally slides between a lock position and a fire position. In the lock position, the safety bar 118 blocks the trigger 114 and prevents the trigger 114 from pivoting to release the sear 100 from the receiver opening 40. In the fire position, the safety bar 118 allows the trigger 114 to pivot and release the sear 100 from the receiver opening 40.

The multi-purpose projectile launcher 10 can be quickly and easily configured to launch a variety of different types of devices such as, for example, projectiles, bola or hobble lines, and nets. FIGS. 4–7 illustrate the projectile launcher 10 configured with a short gas-tube cap 122 to launch a solid projectile 124. FIGS. 8–13 illustrate the projectile launcher 10 configured with a long gas-tube cap 126 and a deployment deflector 128 to launch a hobble assembly 130. FIGS. 14–18 illustrate the projectile launcher 10 configured with the long gas-tube cap 126 and a deployment deflector tube 132 to launch a net assembly 134.

Figure 4:
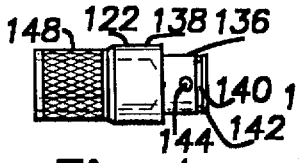
FIG. 4 is an elevational side view of a short gas-tube cap according to the present invention.
Figure 5:
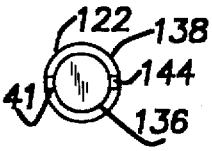
FIG. 5 is an elevational end view of the short gas-tube of FIG. 4.
Figure 7:
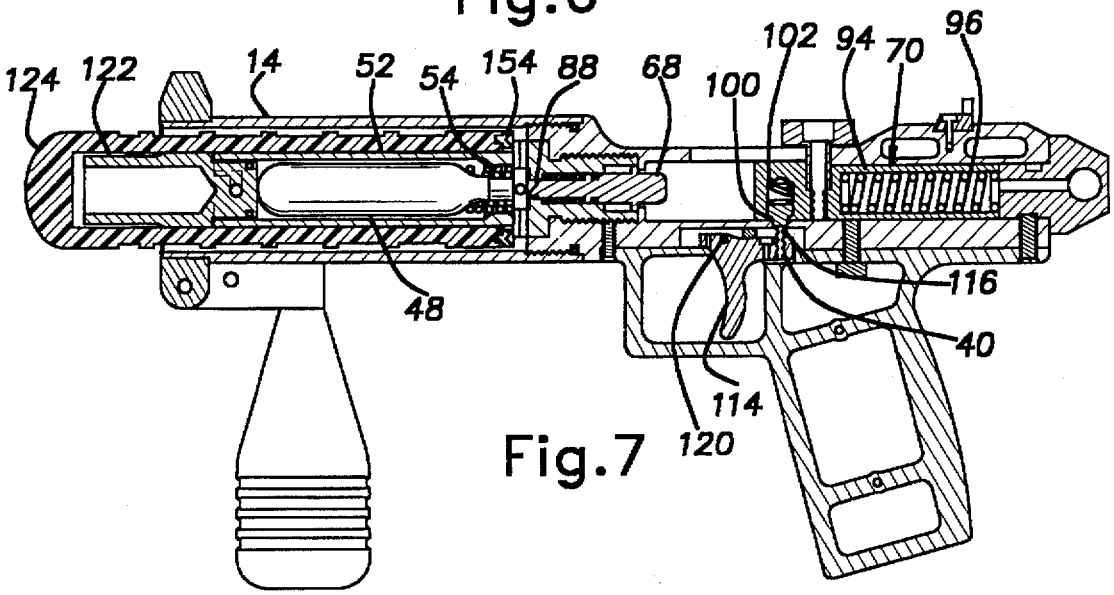
FIG. 7 is an elevational view, in cross-section, of the projectile launcher of FIGS. 1–3 with the short gas-tube cap of FIGS. 4–5 and the solid projectile of FIG. 6.

As best shown in FIGS. 4, 5, and 7 the short gas-tube cap 122 has a cylindrically-shaped rear portion 136 and a cylindrically-shaped front portion 138 with a diameter larger than the diameter of the rear portion 136 to form a rearward facing abutment. The rear portion 136 has an outer diameter sized to closely fit within and sealingly close the forward end of the gas tube 48. A groove 140 is located on the rear portion 136 for an o-ring 142 or other suitable sealing member. The o-ring 142 establishes a seal between the periphery of the rear portion 136 and the inner surface of the gas tube 48. The rear portion also has a pair of bayonet-style projections or pins 144 extending laterally from opposite sides the rear portion 136. The pins 144 cooperate with a pair of bayonet-style locking slots 146 (best shown in FIG. 3) located at the forward end of the gas tube 48. The locking slots 146 are shaped for locking the short gas-tube cap 122 to the gas tube 48 with clockwise rotation.

The front portion 138 of the short gas-tube cap 122 has an outer diameter substantially equal to the outer diameter of the gas tube 48 to provide a smooth transition therebetween. The front portion 138 longitudinally extends out the forward end of the barrel 14. Preferably, a section of the front portion outside the barrel 14 is provided with a gripping surface 148 such as, for example, a knurled surface to ease installation and removal of the small gas-tube cap 122. The gripping surface 148 should have an outer diameter smaller than the remainder of the front portion 138 to prevent contact with the solid projectile 124.

Figure 6:
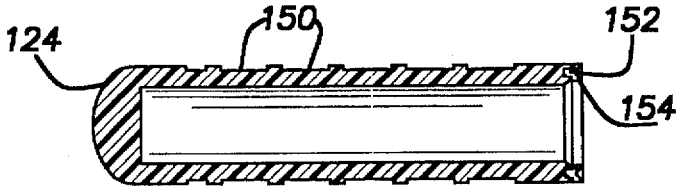
FIG. 6 is an elevational view in cross-section, of a solid projectile according to the invention.

As best shown in FIGS. 6 and 7, the solid projectile 124 is tubular-shaped with a closed forward end and an open rearward end. Preferably, the solid projectile 124 is injection molded of a plastic material. The inner diameter of the solid projectile 124 is sized to fit closely over the outer diameters of the front portion 138 of the short gas-tube cap 122 and the gas tube 48. The outer diameter of the solid projectile 124 is sized to closely fit within the inner diameter of the barrel 14. Preferably, the outer surface of the solid projectile 124 forms circumferentially extending recesses 150 to reduce the amount of contact area with the barrel 14 and thereby friction created by relative movement therebetween. A groove 152 is provided at the rearward end of the solid projectile 124 which secures a ring-shaped seal member 154 to the solid projectile 124. The seal member 154 provides a seal between the outer surface of the gas tube 48 and the inner surface of the barrel 14.

The solid projectile 124 is fully inserted into the barrel 14 over the short gas-tube cap 122 and the front portion of the gas tube 48. In this position, the seal member 154 is adjacent and/or engaging the central portion of the gas tube 48 and the closed front end of the solid projectile 124 is adjacent the forward end of the short gas-tube cap 122. The solid projectile 122 substantially fills the annular space 50 (FIG. 3) between the barrel 14 and the gas tube 48.

To fire the projectile launcher 10, the operator aims the barrel 14 toward a target and rearwardly pulls the trigger 114. The trigger 114 pivots about the pin 120 and the sear release pin 116 is raised toward the bottom surface of the sear 100. The sear release pin 116 engages the sear 100 and overcomes the downward force of the sear spring 102 to upwardly move the sear 100. When the sear 100 is out of the receiver opening 40, the potential energy stored in the compressed hammer spring 96 is released. The hammer spring 96 rapidly drives the hammer 94 in a forward direction and the hammer 94 impacts the rearward end or impact surface 84 of the piercing pin 68. The impact drives the piercing pin 68 in a forward direction such that the piercing point 88 is driven into the end of the cartridge 52.

The piercing point 88 pierces an opening in the cartridge 52 and compressed gas is released from the cartridge 52. The groove 92 (FIGS. 19 and 20) in the piercing pin 68 provides an escape path for the compressed gas. The groove 92 along with a return spring 155 ensure that the piercing pin 68 does not seal or block the pierced opening in the cartridge 52 to prevent the pressurized gas from escaping. The pressure of the escaping gas instantly reacts on the smaller mass of the piercing pin 68 rather than on the projectile 124. The piercing pin 68 is sealed by the o-ring 80 and is forced out of the pierced opening in the cartridge 52 by the escaping pressurized gas. The piercing pin return spring 155 also ensures the retraction of the piercing pin 68 from the pierced opening in the cartridge 52.

It is noted that if the cartridge 52 is a self-generating gas cartridge, the piercing pin 68 is provided with a firing pin in place of the piercing point 88. The firing pin strikes a primer and gas is generated by burning gun powder. The o-ring 80 ensures that gas doesn't escape past the firing pin.

Escaping pressurized gas fills the sealed inner chamber formed within the projectile launcher 10, by the gas tube 48, the piercing pin 68, the barrel 14, and the projectile 124. The pressure of the released gas forwardly launches the solid projectile 124 over the gas tube 48 and out of the barrel 14. The solid projectile 124 travels through the air at a relatively high velocity and strikes the target such as, for example, a threatening individual or animal. The projectile launcher 10 is reloaded by first removing the small gas-tube cap 122 and the spent cartridge 52 is ejected from the gas tube 48 by the spring 54. A new pressurized gas cartridge 52 is then inserted into the gas tube 48 and the small gas-tube cap 122 is installed. The small gas-tube cap 122 rearwardly moves the cartridge 52 compressing the spring 54 until the cartridge 52 engages the central portion of the gas tube 48. Another solid projectile 124 is then inserted into the barrel 14 over the gas tube 48. After cocking the hammer mechanism 70 as described above, the projectile launcher 10 is ready to fire the solid projectile 124.

Figure 8:
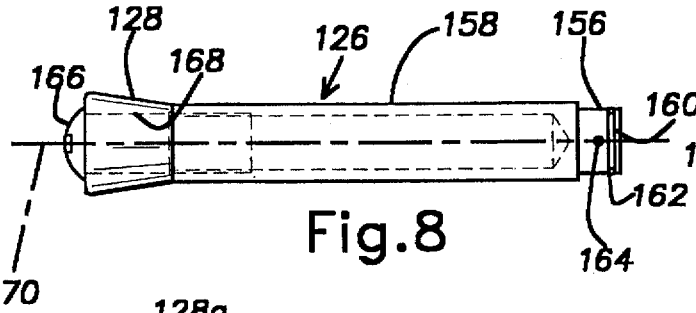
FIG. 8 is a elevational side view of a long gas-tube cap according to the present invention.
Figure 9:
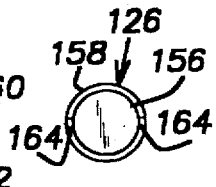
FIG. 9 is an elevational end view of the long gas-tube cap of FIG. 8.
Figure 13:
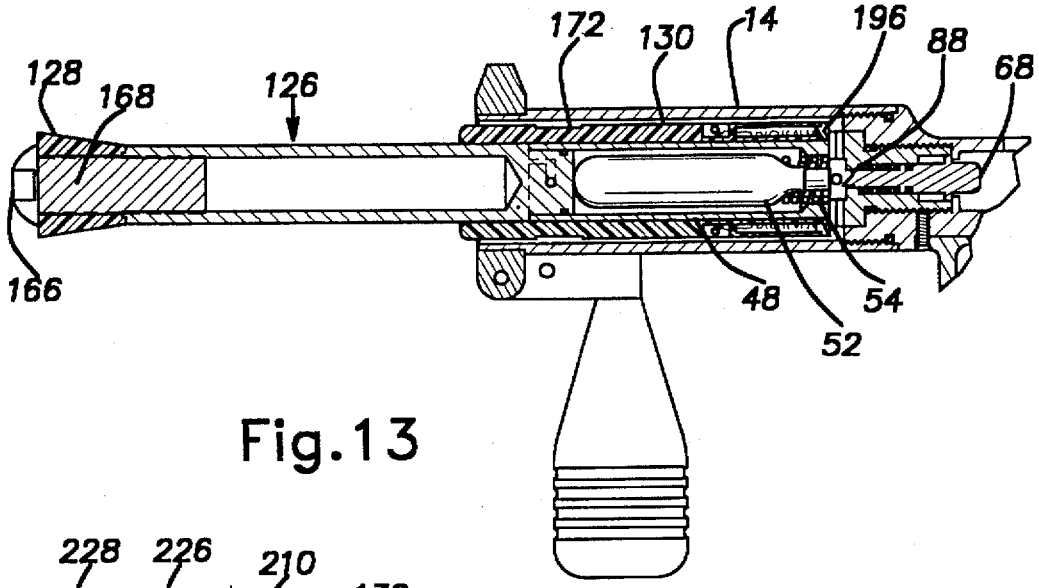
FIG. 13 is a fragmented elevational view, in cross-section, of the projectile launcher of FIGS. 1–3 with the long gas-tube cap of FIGS. 8–9, the deployment deflector of FIG. 10B, and the two-segment projectile of FIGS. 11–12.
Figure 14:
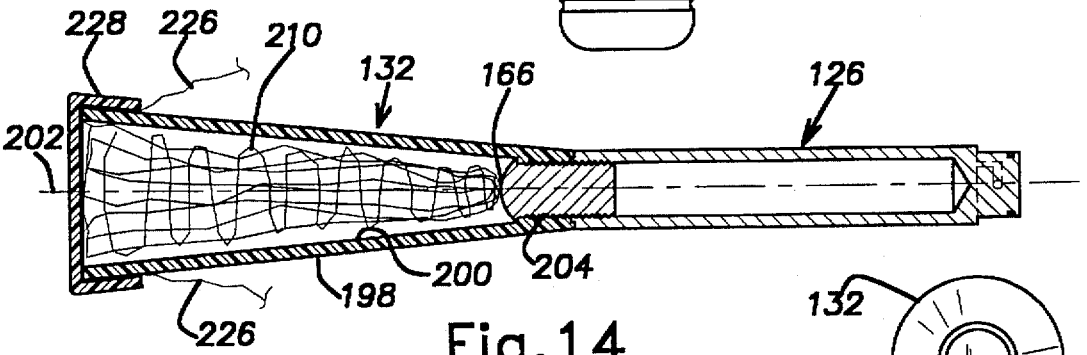
FIG. 14 is a elevational side view of the long gas-tube cap of FIGS. 8–9 with a deflector tube and net.

Alternatively, the projectile launcher 10 can be configured with the long gas-tube cap 126 and the deployment deflector 128 to fire the hobble assembly 130. As best shown in FIGS. 8, 9, and 13, the long gas-tube cap 126 has a cylindrically-shaped rear portion 156 and a cylindrically-shaped front portion 158 with a diameter larger than the diameter of the rear portion 156 to form a rearward facing abutment. The rear portion 156 has an outer diameter sized to closely fit within and to sealingly close the forward end of the gas tube 48. A groove 160 is located on the rear portion 156 for an o-ring 162 or other suitable sealing member. The o-ring 162 establishes a seal between the periphery of the rear portion 156 and the inner surface of the gas tube 48. The rear portion 156 also has a pair of bayonet-style projections or pins 164 extending laterally from opposite sides the rear portion 156. The pins cooperate with the locking slots 146 (best shown in FIG. 3) located at the forward end of the gas tube 48 as described above for the short gas-tube cap 122. The front portion 158 of the long gas-tube cap has an outer diameter substantially equal to the outer diameter of the gas tube 48 to provide a smooth transition therebetween.

The deflector 128 is generally frusto-conically-shaped having an increasing diameter in the forward direction. The rearward end of the deflector 128 has an outer diameter which is substantially equal to the outer diameter of the front portion 158 of the long gas-tube cap 126. A deflector bolt 166 secures the deflector 128 to the forward end of the long gas-tube cap 126. The deflector bolt 166 longitudinally extends through a central bore 168 of the deflector 128 and mates with internal threads in the forward end of the long gas-tube cap 126. The front portion of the long gas-tube cap 126 longitudinally extends out the forward end of the barrel 14 a distance which substantially allows the hobble assembly 130 to exit the barrel 14 before reaching the deflector 128.

Figure 10A:
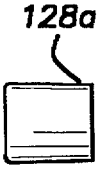
FIGS. 10A, 10B, and 10C are elevational side views of deployment deflectors according to the present invention.
Figure 10B:
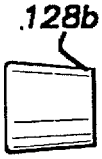
Figure 10C:
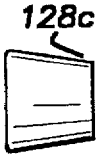

The deflector 128 preferably forms a deflection or total angle in the range of about 4 degrees to about 16 degrees. FIG. 10A illustrates a deflector 128*a* having a total angle of about 4 degrees, that is, the peripheral surface is at an angle of about 2 degrees relative to the central axis 170. FIG. 10B illustrates a deflector 128*b* having a total angle of about 8 degrees, that is, the peripheral surface is at an angle of about 4 degrees relative to the central axis 170. FIG. 10C illustrates a deflector 128*c* having a total angle of about 16 degrees, that is, the peripheral surface is at an angle of about 8 degrees relative to the central axis 170.

Figure 11:
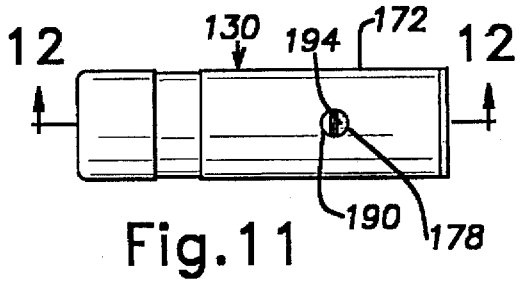
FIG. 11 is an elevational side view of a two-segment projectile with connecting lines according to the invention.
Figure 12:
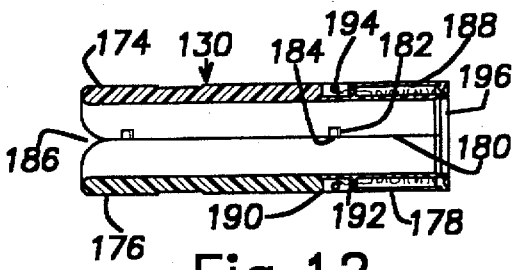
FIG. 12 is an elevational view, in cross-section, taken along line 12—12 of FIG. 11.

As best shown in FIGS. 11, 12, and 13, the hobble assembly 130 includes a segmented projectile 172 having first and second segments 174, 176 and multiple cords or lines 178 connecting the first and second segments 174, 176. The segmented projectile 172 is tubular-shaped with an open forward end and an open rearward end. The inner diameter of the segmented projectile 172 is sized to fit closely over the outer diameters of the front portion 158 of the long gas-tube cap 126 and the gas tube 48. The outer diameter of the segmented projectile 172 is sized to closely fit within the inner diameter of the barrel 14. The segmented projectile 172 is formed by the first and second segments 174, 176 which mate along a longitudinally extending parting plane 180. The segments 174, 176 are provided with cooperating pins 182 and openings 184 to align the segments 174, 176 relative to one another. The forward ends of the segments 174, 176 are preferably provided with a clearance space or gap 186, such as the illustrated chamfer, to prevent wedging of the segmented projectile 172 on the deflector 128.

A relatively deep slot or groove 188 is provided at the rearward end of the segmented projectile 172 which provides a cavity for the lines 178. Each of the segments 174, 176 has a radially extending counter bore 190 located on the exterior surface slightly forward of the forward end of the groove 188. A longitudinally extending hole 192 connects the rearward end of the counter bore 190 with the forward end of the groove 188.

A first end of each of the lines 178 is attached to a pin 194 located in the counter bore 190 of the first segment 174. The pin 194 has a length greater than the diameter of the hole 192. The lines 178 extend from the pin 194 to the groove 188 through the connecting hole 192 so that the first end of each of the lines is secured to the first segment 174. The second end of each of the lines 178 is similarly secured to the second segment 176 so that the first and second segments 174, 176 are connected together by the lines 178. It is noted that the lines 178 must be arranged in the groove 188 in a manner which allows the segments 174, 176 to freely separate until the lines 178 are fully extended. The groove 188 also secures a ring-shaped seal member 196 to the rearward end of the segmented projectile 172. The seal member 196 provides a seal between the outer surface of the gas tube 48 and the inner surface of the barrel 14. It is noted that the seal member 196 can advantageously be the same as the seal member 154 of the solid projectile 124 (FIG. 6).

Preferably, there are three lines 178 connecting the first and second segments 174, 176 of the segmented projectile 172. The lines 178 preferably have increasing lengths, that is, the first line has a shorter length than the second line and the second line has a shorter length than the third line, in order to increase tangling. The lines 178 preferably comprise a high strength material such as, for example, Poly-p-phenylene terephthalamide which is commercially available under the trademark KEVLAR. Additionally, the shortest or first line can be of lower strength than the longer or second and third lines. Good results have been obtained with a first line of about 100 # test KEVLAR having a length of about 7 feet, a second line of about 150 # test KEVLAR having a length of about 7 feet and six inches, and a third lines of about 150 # test KEVLAR having a length of about 8 feet.

As best shown in FIG. 13, the segmented projectile 172 is fully inserted into the barrel 14 over the long gas-tube cap 126 and the front portion of the gas tube 48. In this position, the seal member 196 is adjacent and/or engaging the central portion of the gas tube 48. The segmented projectile 172 substantially fills the annular space 50 (FIG. 3) between the barrel 14 and the gas tube 48.

The projectile launcher 10 operates in the same manner as discussed above with regard to the solid projectile 124. However, the deflector 128 separates the first and second segments 174, 176 as the segmented projectile 172 passes over the deflector 128. The first and second segments 174, 176 continue to separate as they forwardly project through the air toward the target until the shortest one of the lines 178 is fully extended. When the shortest one of the lines 178 reaches its maximum length, the first and second segments 174, 176 are recoiled back towards each other. The shortest one of the lines 178 may be severed in this process. The first and second segments 174, 176 then spin to wrap and tangle the lines 178 around the target such as, for example, the legs of a fleeing individual or animal.

The segmented projectile 172 must be fired at the optimal working range or distance from the target in order to obtain the recoil at the proper time. The separation angle of the deflector 128 determines the rate of separation of the first and second segments 174, 176 where a larger angle causes the segments 174, 176 to separate faster. Therefore, the deflector 128 must have the appropriate separation angle for a desired working range or distance.

Figure 15:
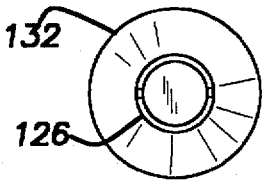
FIG. 15 is an elevational end view of the long gas-tube cap, deflector tube, and net of FIG. 14.
Figure 16:
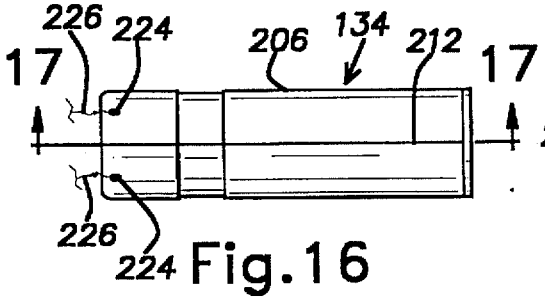
FIG. 16 is an elevational side view of a four-segment projectile according to the invention.
Figure 17:
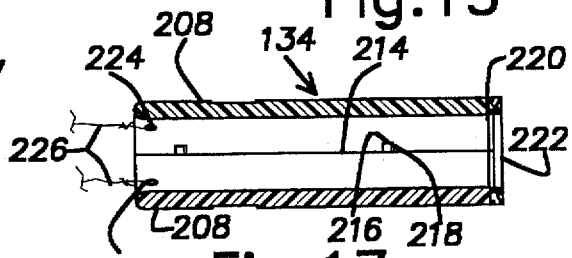
FIG. 17 is an elevational view, in cross-section, taken along line 17—17 of FIG. 16.
Figure 18:
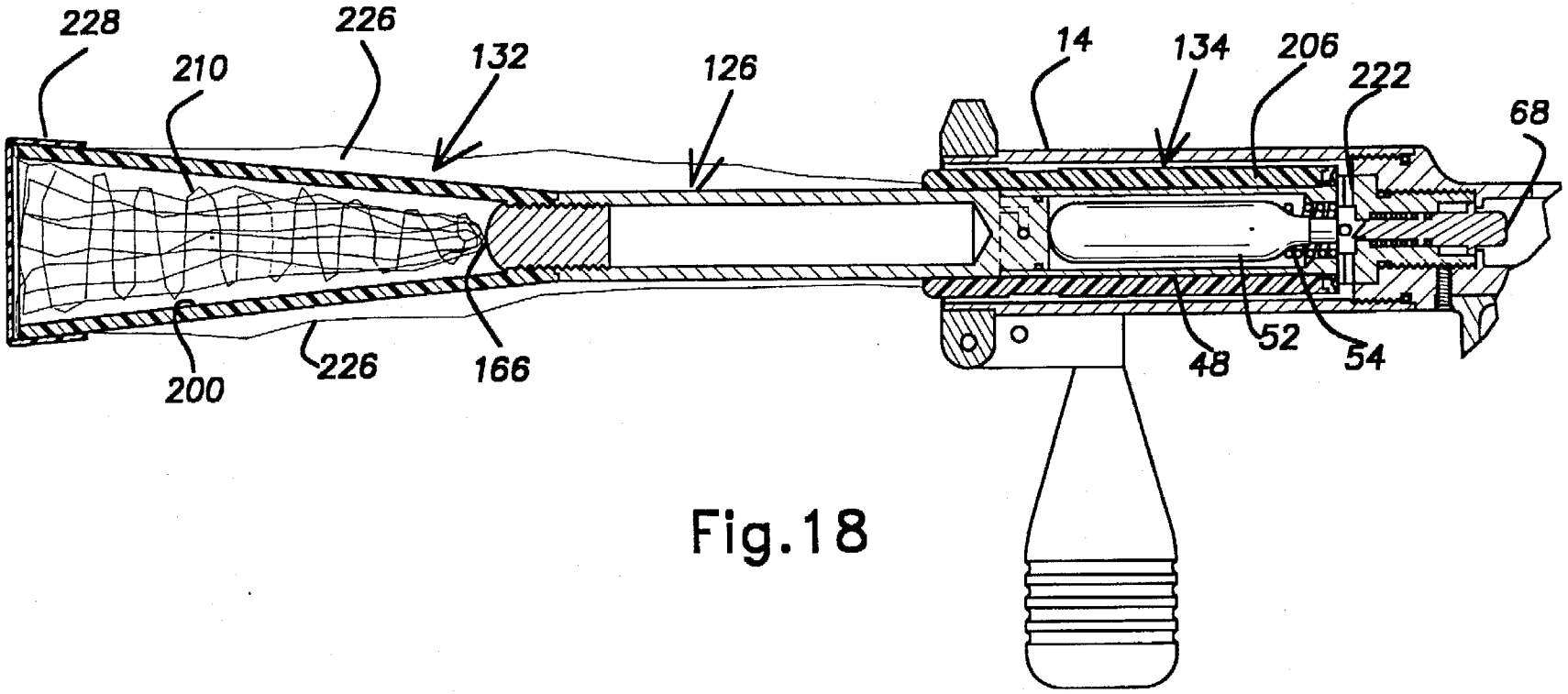
FIG. 18 is a fragmented elevational view, in cross-section, of the projectile launcher of FIGS. 1–3 with the long gas-tube cap, deflector tube, and net of FIGS. 14–15 and the four-segment projectile of FIGS. 16–17.

Alternatively, the projectile launcher 10 can be configured with the long gas-tube cap 126 and the deflector tube 132 to fire the net assembly 134. As best shown in FIGS. 14, 15, and 18, the long gas-tube cap 126 is the same as described above with regard to FIGS. 8,9, and 14. The deflector tube 132 has generally frusto-conically-shaped exterior surface 198 with an increasing diameter in the forward direction and a frusto-conically shaped interior cavity 200. The deflector tube 132 preferably has a deflection or total angle of about 8 degrees, that is, the exterior surface 198 is at an angle of about 4 degrees relative to the central axis 202. The interior cavity 200 has an open forward end and a generally closed rearward end. The rearward end of the deflector tube 132 has an outer diameter which is substantially equal to the outer diameter of the front portion 158 of the long gas-tube cap 126. The deflector bolt 166 secures the deflector tube 132 to the forward end of the long gas-tube cap 126. The deflector bolt 166 longitudinally extends through a bore 204 located at the rearward end of the deflector tube 132 and mates with internal threads in the forward end of the long gas-tube cap 126.

As best shown in FIGS. 14–18, the net assembly 134 includes a segmented projectile 206 having four segments 208 (only two of which are visible in any one of the figures) and a rectangular-shaped net 210 with each corner connected to a separate one of the segments 208. The segmented projectile 206 is tubular-shaped with an open forward end and an open rearward end. The inner diameter of the segmented projectile 206 is sized to fit closely over the outer diameters of the front portion of the long gas-tube cap 126 and the gas tube 48. The outer diameter of the segmented projectile 206 is sized to closely fit within the inner diameter of the barrel 14. The segmented projectile 206 is formed by the four equal sized segments 208 which mate along two longitudinally extending and perpendicular parting planes 212, 214. The segments 208 are provided with cooperating pins 216 and openings 218 to align the segments 208 relative to one another. A slot or groove 220 is provided at the rearward end of the segmented projectile 206. The groove 220 secures a ring-shaped seal member 222 to the rearward end of the segmented projectile 206. The seal member 222 provides a seal between the outer surface of the gas tube 48 and the inner surface of the barrel 14. It is noted that the seal member 222 can advantageously be the same as the seal member 154 of the solid projectile 124 (FIG. 6) and the seal member 196 of the two-segment projectile 172 (FIG. 12). A hole or opening 224 is provided at the forward end of each of the segments 208.

Four lines or leaders 226 each have a first end attached to a corner of the net 210 and a second end secured to the opening 224 of an associated one of the segments 208. Therefore, each one of the four segments 208 are attached to a different one of the four corners of the net 210. The net 210 is preferably woven of a high strength fiber such as, for example, nylon or Poly-p-phenylene terephthalamide which is commercially available under the trademark KEVLAR. Additionally, the leaders 226 preferably comprise a high strength material such as, for example, Poly-p-phenylene terephthalamide. Good results have been obtained with a net 210 having fibers of about 80 # test to about 100 # test KEVLAR and leaders of about 150 # KEVLAR.

As best shown in FIG. 18, the segmented projectile 206 is fully inserted into the barrel 14 over the long gas-tube 126 cap and the front portion of the gas tube 48. In this position, the seal member 222 is adjacent and/or engaging the central portion of the gas tube 48. The segmented projectile 206 substantially fills the annular space 50 (FIG. 3) between the barrel 14 and the gas tube 48. The leaders 226 extend from the segments 208 of the segmented projectile 206 to the forward end of the deflector tube 132 and into the interior cavity 200 where the net 210 is positioned. It is noted that the leaders 226 and net 210 must be arranged in a manner which allows the segments 208 to freely separate so that the net 210 can fully extend or deploy. Preferably, a deflector tube cap 228 made from a flexible material such as soft vinyl or rubber is provided over the open forward end of the deflector tube 132 to retain the net in its proper position until the segmented projectile 208 pulls the net 210 from the deflector tube 132.

The projectile launcher 10 operates in the same manner as discussed above with regard to the solid projectile 124. However, the deflector tube 132 separates the four segments 208 as the segmented projectile 206 passes over the deflector tube 132. The segments 208 pull the leaders 226 forward and strip the cap 228 off the deflector tube 132 and pull the net 210 from the deflector tube 132 as they forwardly project beyond the deflector tube 132. The segments 208 continue to separate as they forwardly project through the air toward the target until the net 210 is fully extended and/or strikes and entangles the target such as a fleeing individual or animal. The segmented projectile 206 must be fired at an optimal range or distance from the target in order for the net 210 to properly deploy. It has been found that the net 210 properly deploys when fired from a distance of about 10 feet when the deflector tube 132 has a deflection angle of about 8 degrees, but other combinations can be obtained with various deployment angles.

It can be seen from the above description that the projectile launcher 10 can be easily and quickly configured to launch a number of different types of projectiles. It can also be seen that the projectile launcher 10 is particularly effective at deploying multiple projectiles at the same speed in order to evenly deploy a hobble line or net.

Although particular embodiments of the invention have been described in detail, it will be understood that the invention is not limited correspondingly in scope, but includes all changes and modifications coming within the spirit and terms of the claims appended hereto.

What is claimed is:

1. A launcher for deploying projectiles, said launcher comprising:

a body, a barrel forwardly projecting from said body;

a tube forwardly projecting from said body within said barrel and substantially concentric with said barrel to form an annular-shaped space therebetween for the projectiles at least a forward end of said tube being closed; and a firing assembly at least partly within said body and including at least one passage in fluid flow communication with a rearward end of said space, wherein said firing assembly is adapted to selectively release pressurized gas into said space through said passage and behind the projectile.

2. The launcher according to claim 1, further comprising a removable cap closing the forward end of said tube.

3. The launcher according to claim 1, wherein a forward end of said tube is provided with a deflector for deflecting the projectiles radially outward from said tube.

4. The launcher according to claim 3, wherein said deflector has a generally frusto-conically shaped exterior surface coaxial with said tube, said exterior surface having an increasing diameter in a forward direction.

5. The launcher according to claim 4, wherein said exterior surface has a total angle in the range of about 4 degrees to about 16 degrees.

6. The launcher according to claim 5, wherein said exterior surface has a total angle of about 8 degrees.

7. The launcher according to claim 3, wherein said deflector forms a forwardly facing hollow interior cavity.

8. A launcher for deploying projectiles using a gas cartridge, said launcher comprising:

a body, a barrel forwardly projecting from said body;

a tube forwardly projecting from said body within said barrel and substantially concentric with said barrel to form an annular-shaped space therebetween, said tube at least partly forming an interior chamber in fluid flow communication with a rearward end of said space, at least a forward end of said tube being closed; and a firing assembly at least partly within said body for striking the gas cartridge to release gas into said interior chamber.

9. The launcher according to claim 8, wherein said firing assembly includes a pin for piercing the gas cartridge to release pressurized gas from the gas cartridge into said interior chamber, said pin having a longitudinally extending groove therein for providing a passage for gas from the gas cartridge to aid in the withdrawal of said pin from the gas cartridge.

10. The launcher according to claim 8, wherein said firing assembly includes a pin for piercing the gas cartridge to release pressurized gas from the gas cartridge into said interior chamber, said pin having a forward facing shoulder for limiting a length of said pin entering the gas cartridge to prevent said pin from sticking in the gas cartridge.

11. The launcher according to claim 8, wherein said tube is sized for receiving the gas cartridge therein and has a forward end sealingly closed by a removable cap.

12. A projectile launcher in combination with a projectile, said combination comprising:

a generally tubular-shaped projectile; and a projectile launcher including:

a body;

a barrel forwardly projecting from said body;

a tube forwardly projecting from said body within said barrel and substantially concentric with said barrel to form an annular-shaped space therebetween for said projectile, said projectile encircling said tube, at least a forward end of said tube being closed; and a firing assembly at least partly within said body and including at least one passage in fluid flow communication with a rearward end of said space, wherein said firing assembly is adapted to selectively release pressurized gas into said space through said passage and behind said projectile.

13. The combination according to claim 12, wherein said projectile forms a seal between an interior surface of said barrel and an exterior surface of said tube.

14. The combination according to claim 12, wherein said projectile includes at least two longitudinally extending segments and a forward end of said tube is provided with a deflector for separating said segments and deflecting said segments radially outward from said tube.

15. The combination according to claim 14, wherein said deflector has a generally frusto-conically shaped exterior surface coaxial with said tube, said exterior surface having an increasing diameter in a forward direction.

16. The combination according to claim 14, wherein said projectile has two of said segments and said segments are connected by multiple lines.

17. The combination according to claim 16, wherein said lines have differing lengths.

18. The combination according to claim 14, wherein said projectile has four of said segments and each of said segments are connected to an associated corner of a net.

19. The combination according to claim 18, wherein said deflector forms a forwardly facing hollow interior cavity for said net.

20. The combination according to claim 18, wherein said net is woven from high strength fibers.

* * * * *

UNITED STATES PATENT AND TRADEMARK OFFICE

CERTIFICATE OF CORRECTION

PATENT NO. : 5,706,795
DATED : January 13, 1998
INVENTOR(S) : Gerwig

It is certified that error appears in the above-indentified patent and that said Letters Patent is hereby corrected as shown below:

Column 1, line 65, after "Fig. 2" insert --.--.

Column 1, line 67, delete "Fig. 2" and insert --Fig. 1--.

Column 2, line 3, after "gas-tube" insert --cap--.

Signed and Sealed this

Twenty-first Day of April, 1998

Bruce Lehman

*Attest:*

BRUCE LEHMAN

*Attesting Officer*

*Commissioner of Patents and Trademarks*